US008499745B2

(12) United States Patent
Ishiki et al.

(10) Patent No.: US 8,499,745 B2
(45) Date of Patent: Aug. 6, 2013

(54) FUEL SUPPLY SYSTEM OF VEE ENGINE

(75) Inventors: Kazuya Ishiki, Wako (JP); Kazuaki Naramoto, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 201 days.

(21) Appl. No.: 13/172,838

(22) Filed: Jun. 30, 2011

(65) Prior Publication Data

US 2012/0017875 A1 Jan. 26, 2012

(30) Foreign Application Priority Data

Jul. 26, 2010 (JP) ..... 2010-167230

(51) Int. Cl.
*F02M 55/02* (2006.01)

(52) U.S. Cl.
USPC ..... 123/468; 123/456; 123/469

(58) Field of Classification Search
USPC ..... 123/456, 468, 469
See application file for complete search history.

(56) References Cited

U.S. PATENT DOCUMENTS

| | | | | |
|---|---|---|---|---|
| 5,433,182 | A * | 7/1995 | Augustin et al. | 123/456 |
| 5,445,130 | A * | 8/1995 | Brummer et al. | 123/456 |
| 5,511,527 | A * | 4/1996 | Lorraine et al. | 123/456 |
| 5,943,994 | A * | 8/1999 | Hosoi et al. | 123/468 |
| 6,237,547 | B1 * | 5/2001 | Ishiyama | 123/41.31 |
| 6,250,290 | B1 * | 6/2001 | Mullen | 123/541 |
| 6,367,451 | B2 * | 4/2002 | Kato | 123/456 |
| 6,460,511 | B2 * | 10/2002 | Kato | 123/468 |
| 6,684,858 | B2 * | 2/2004 | Sato et al. | 123/468 |
| 6,807,944 | B2 * | 10/2004 | Mizuno et al. | 123/467 |
| 7,131,427 | B2 * | 11/2006 | Kawasaki et al. | 123/456 |
| 7,406,946 | B1 * | 8/2008 | Watanabe et al. | 123/470 |
| 8,297,257 | B2 * | 10/2012 | Sugiyama et al. | 123/456 |
| 2002/0038651 | A1 * | 4/2002 | Sato et al. | 123/468 |
| 2004/0069277 | A1 * | 4/2004 | Mizuno et al. | 123/456 |

FOREIGN PATENT DOCUMENTS

JP 2002-349385 12/2002

OTHER PUBLICATIONS

Chinese Office Action for corresponding CN Application No. 201110159551.9, Feb. 4, 2013.

* cited by examiner

*Primary Examiner* — Erick Solis
(74) *Attorney, Agent, or Firm* — Ditthavong Mori & Steiner, P.C.

(57) ABSTRACT

A fuel supply system of a vee engine includes a high-pressure fuel pump. A first delivery pipe is to distribute fuel to injectors disposed on a first bank. A second delivery pipe is to distribute the fuel to injectors disposed on a second bank. The fuel is to be supplied from the high-pressure fuel pump to the first delivery pipe through a first joint pipe. The fuel is to be supplied from the high-pressure fuel pump to the second delivery pipe through a second joint pipe. A direction of a connecting part of the first joint pipe on a side of the high-pressure fuel pump substantially matches a direction of thermal expansion of the first bank. A direction of a connecting part of the second joint pipe on a side of the high-pressure fuel pump substantially matches a direction of thermal expansion of the second bank.

9 Claims, 7 Drawing Sheets

FUEL SUPPLY SYSTEM OF VEE ENGINE

CROSS-REFERENCE TO RELATED APPLICATIONS

The present application claims priority under 35 U.S.C. §119 to Japanese Patent Application No. 2010-167230, filed July 26, 2010, entitled "Fuel Supply System of Vee Engine". The contents of this application are incorporated herein by reference in their entirety.

BACKGROUND OF THE INVENTION

1. Field of the Invention

The present invention relates to a fuel supply system of a vee engine.

2. Description of the Related Art

Japanese Unexamined Patent Application Publication No. 2002-349385 describes a fuel supply system in which two delivery tubes extend along two banks from a single high-pressure pump disposed on one of the two banks of a vee engine and in which the delivery tubes are connected a plurality of injectors disposed in the banks, wherein by interconnecting the two delivery tubes with a bracket at positions close to the high-pressure pump to prevent the generation of vibration and noise due to fuel pulsation.

SUMMARY OF THE INVENTION

According to one aspect of the present invention, a fuel supply system of a vee engine includes a first delivery pipe, a second delivery pipe, a high-pressure fuel pump, a first joint pipe, and a second joint pipe. The first delivery pipe is to distribute fuel to a plurality of injectors disposed on a first bank. The second delivery pipe is to distribute the fuel to a plurality of injectors disposed on a second bank. The high-pressure fuel pump is to pressurize the fuel. The fuel is to be supplied from the high-pressure fuel pump to the first delivery pipe through the first joint pipe. The fuel is to be supplied from the high-pressure fuel pump to the second delivery pipe through the second joint pipe. A direction of a connecting part of the first joint pipe on a side of the high-pressure fuel pump substantially matches a direction of thermal expansion of the first bank. A direction of a connecting part of the second joint pipe on a side of the high-pressure fuel pump substantially matches a direction of thermal expansion of the second bank.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
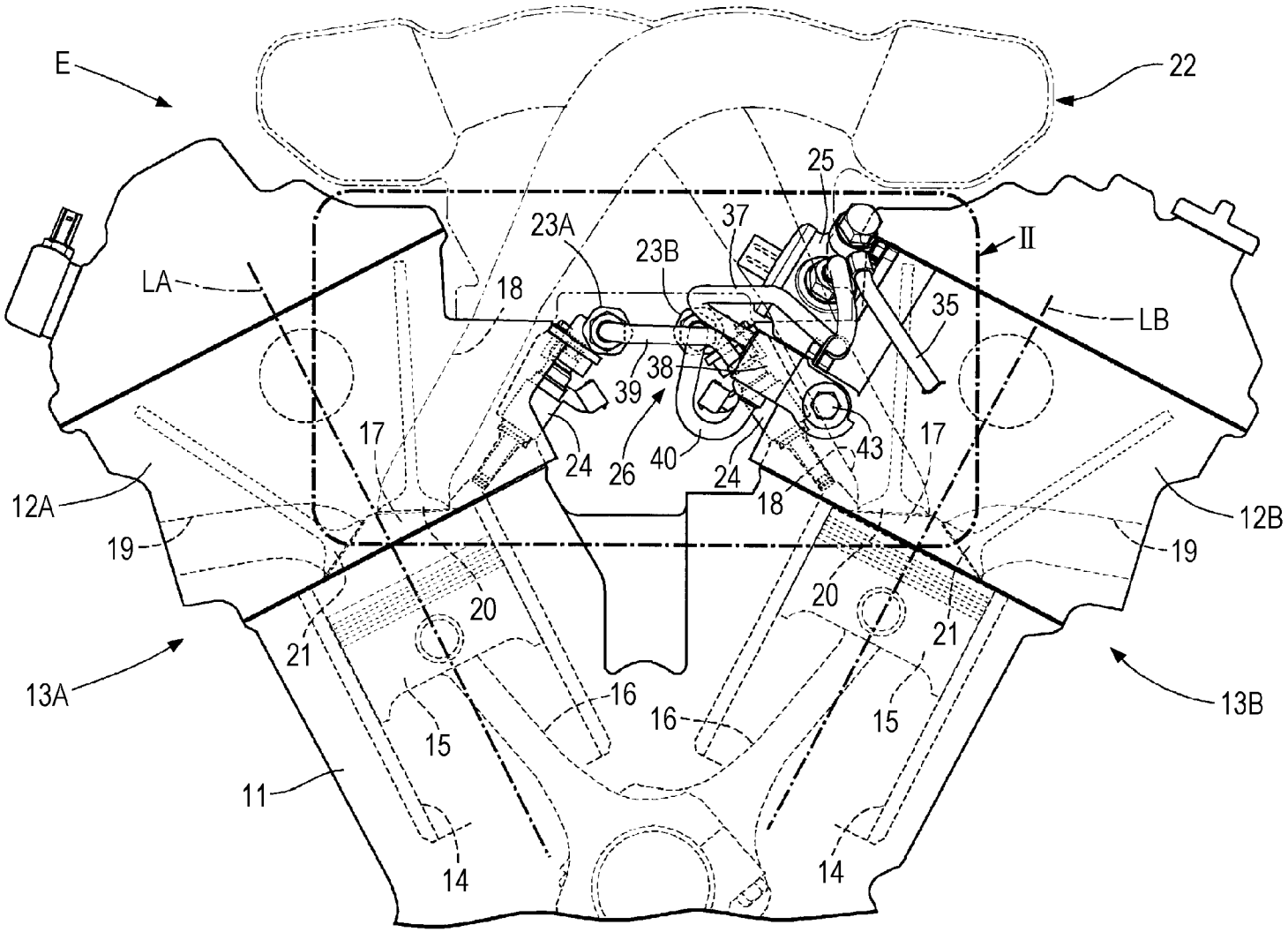
FIG. 1 is a front view of a vee engine.

The embodiments of the present invention will be described below with reference to FIGS. 1 to 7, wherein like reference numerals designate corresponding or identical elements throughout the various drawings.

Figure 2:
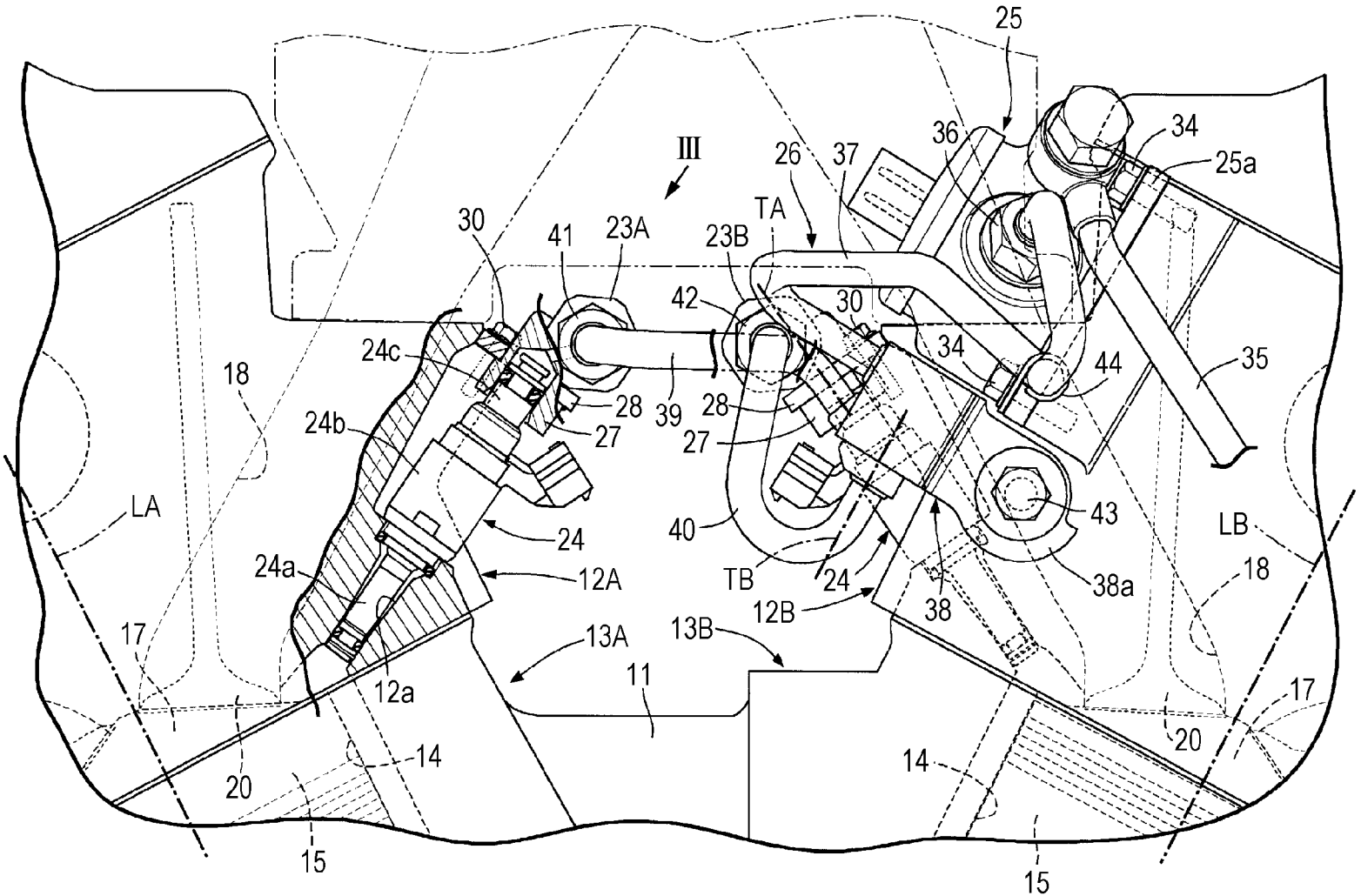
FIG. 2 is an enlarged view of FIG. 1.
Figure 3:
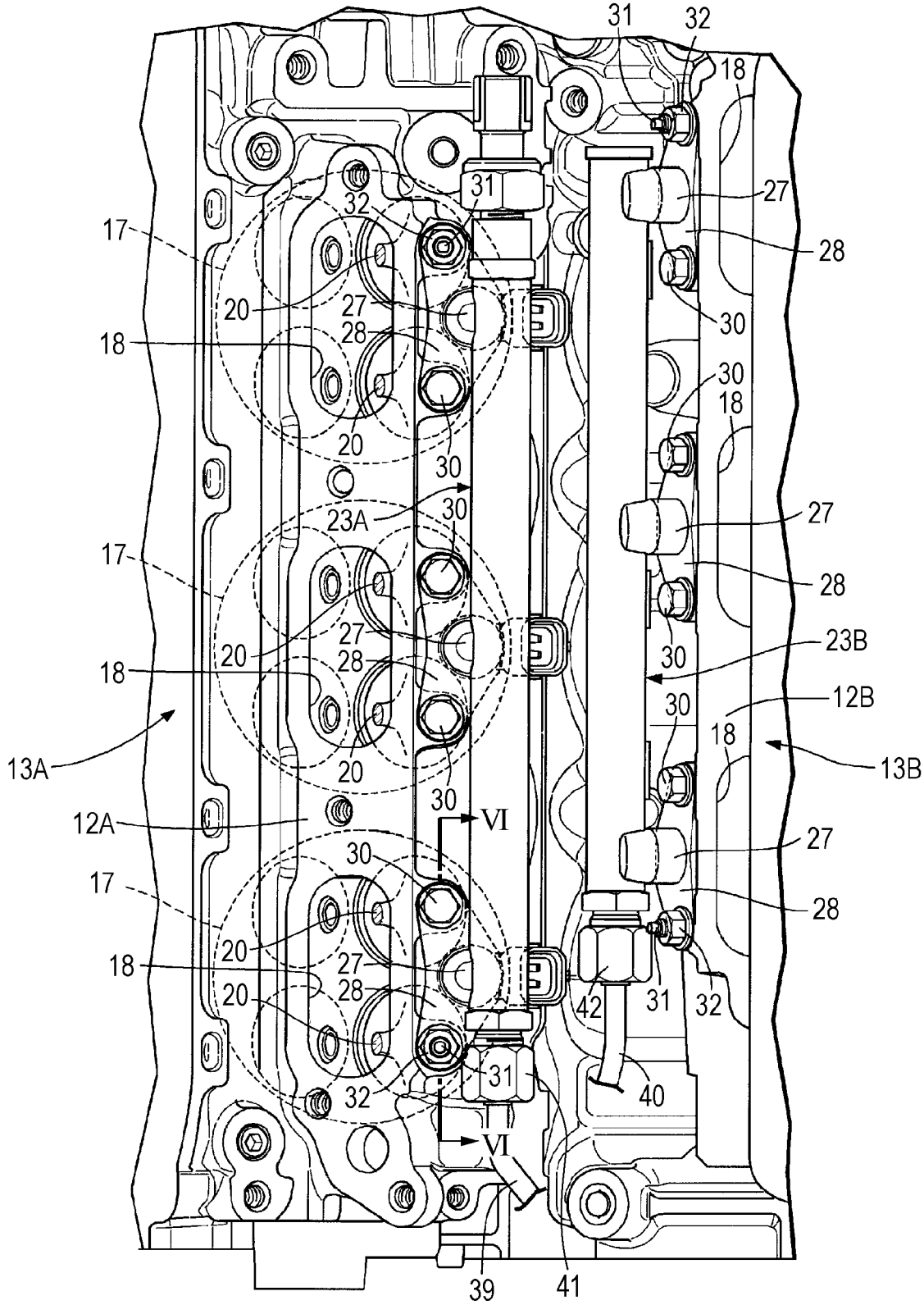
FIG. 3 is a view in the direction indicated by arrow III in FIG. 2.

As illustrated in FIGS. 1 to 3, a fuel-direct-injection six-cylinder vee engine E includes a cylinder block 11, a first cylinder head 12A, and a second cylinder head 12B. Half of the cylinder block 11 and the first cylinder head 12A constitute a first bank 13A, whereas the other half of the cylinder block 11 and the second cylinder head 12B constitutes a second bank 13B.

Each of the banks 13A and 13B includes cylinders 14, pistons 15, connecting rods 16, combustion chambers 17, intake ports 18, exhaustion ports 19, intake valves 20, and exhaustion valves 21. Each intake port 18 is integrated with an intake manifold 22.

A first delivery pipe 23A is disposed on the intake side along the side surface of the first cylinder head 12A.

Three injectors 24 that inject fuel to the combustion chambers 17 of the second cylinder head 12A are connected to the first delivery pipe 23A.

Similarly, a second delivery pipe 23B is dispose on the intake side along the side surface of the second cylinder head 12B. Three injectors 24 that inject fuel to the combustion chambers 17 of the cylinder head 12B are connected to the second delivery pipe 23B.

A single high-pressure fuel pump 25 disposed on the intake side surface of the second cylinder head 12B is connected to the ends of the first and second delivery pipes 23A and 23B through a joint pipe 26.

Since the structures of the first and second delivery pipes 23A and 23B are substantially the same, only the structure of the first delivery pipe 23A will be described below.

Figure 4:
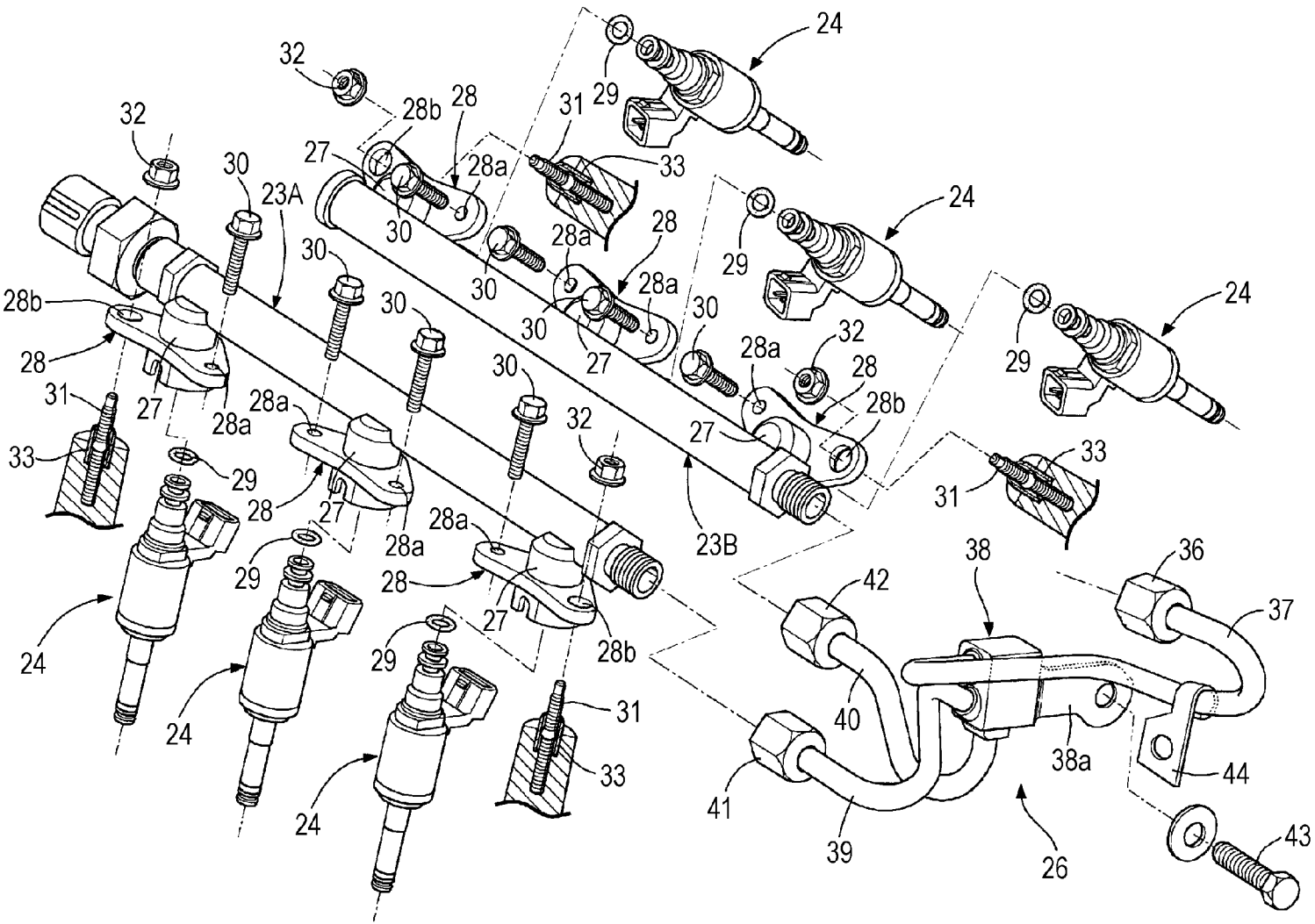
FIG. 4 is an exploded perspective view of a fuel supply system.

As illustrated in FIGS. 2 and 4, the first delivery pipe 23A is a linear pipe with one end closed. Three injector cups 27 are integrated with the first delivery pipe 23A at positions along the longitudinal direction.

Three plate-like attachment stays 28 are integrated with corresponding injector cups 27.

Each injector 24 has a valve storing part 24*a*, an actuator part 24*b*, and a fuel introduction part 24*c*, in order from the combustion chamber 17 side to the first delivery pipe 23*a* side.

The cylindrical valve storing part 24*a* is fit into an injector attachment hole 12*a* in the first delivery pipe 23A, and the cylindrical fuel introduction part 24*c* is fit into the injector cup 27 of the first delivery pipe 23A through a sealing member 29.

Figure 6:
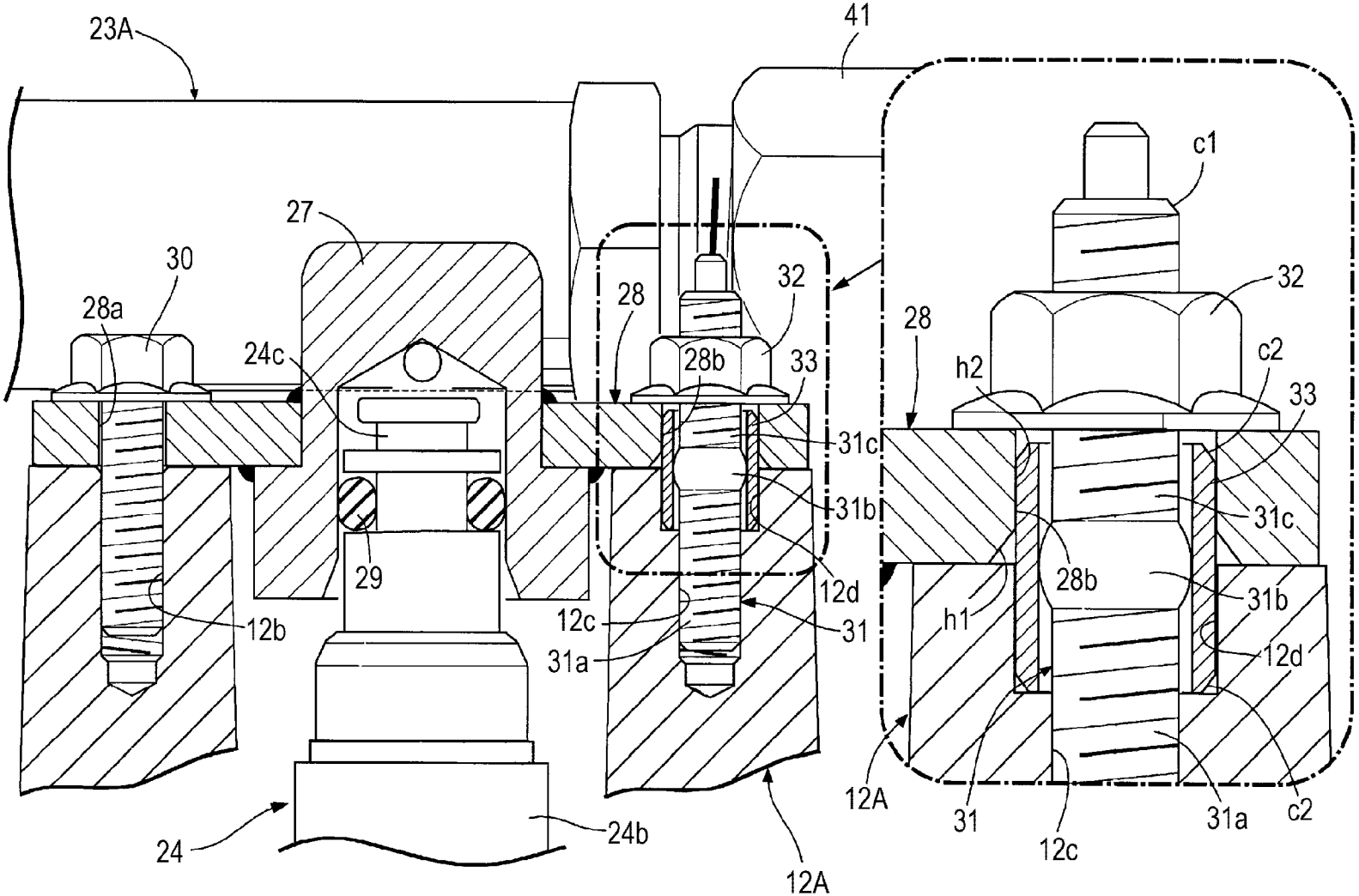
FIG. 6 is an enlarged sectional view taken along line VI-VI.

As illustrated in FIGS. 4 and 6, each attachment stay 28 has two bolt holes.

Four bolts 30, which are passed through four bolt holes 28*a* among the total of six bolt holes formed in the three attachment stays 28 (four bolt holes 28*a* interposed between the two bolt holes at the ends), are screwed into four female threads 12*b* in the first cylinder head 12A.

Among the six bolt holes, the two bolt holes 28*b* at the two ends are not simply cylindrical.

Half of each hole 28*b* closer to the first cylinder head 12A forms a tapered hole h1 that spreads toward the first cylinder head 12A; connected to the tapered hole h1 is an isodiametric part h2 that is finely processed into a cylinder.

The two bolts 28*b* at the two ends are engaged with stud bolts 31, which differ from the above-described bolts 30.

Each stud bolt 31 includes a first male thread 31*a* that screws into a female thread 12*c* of the first cylinder head 12A, a spherical knock-pin contacting part 31*b* that is connected to the first male thread 31*a,* and a second male thread 31*c* that is connected to the knock-pin contacting part 31*b* and receives a nut 32.

The tip of the second male thread 31*c* has chamfered surface c1 that is tapered toward the tip.

The open end of the female thread 12*c* of the first cylinder head 12A receiving the first male thread 31*a* of the stud bolt 31 forms a cylindrical knock-pin hole 12*d* with a larger diameter.

With the first male thread 31*a* of the stud bolt 31 screwed into the female thread 12*c* of the first cylinder head 12A, a cylindrical knock pin 33 is press-fit between the knock-pin hole 12*d* of the first cylinder head 12A and the knock-pin contacting part 31*b* of the stud bolt 31.

Both ends of the knock pin 33 have the tapered chamfer surfaces c2.

Figure 5:
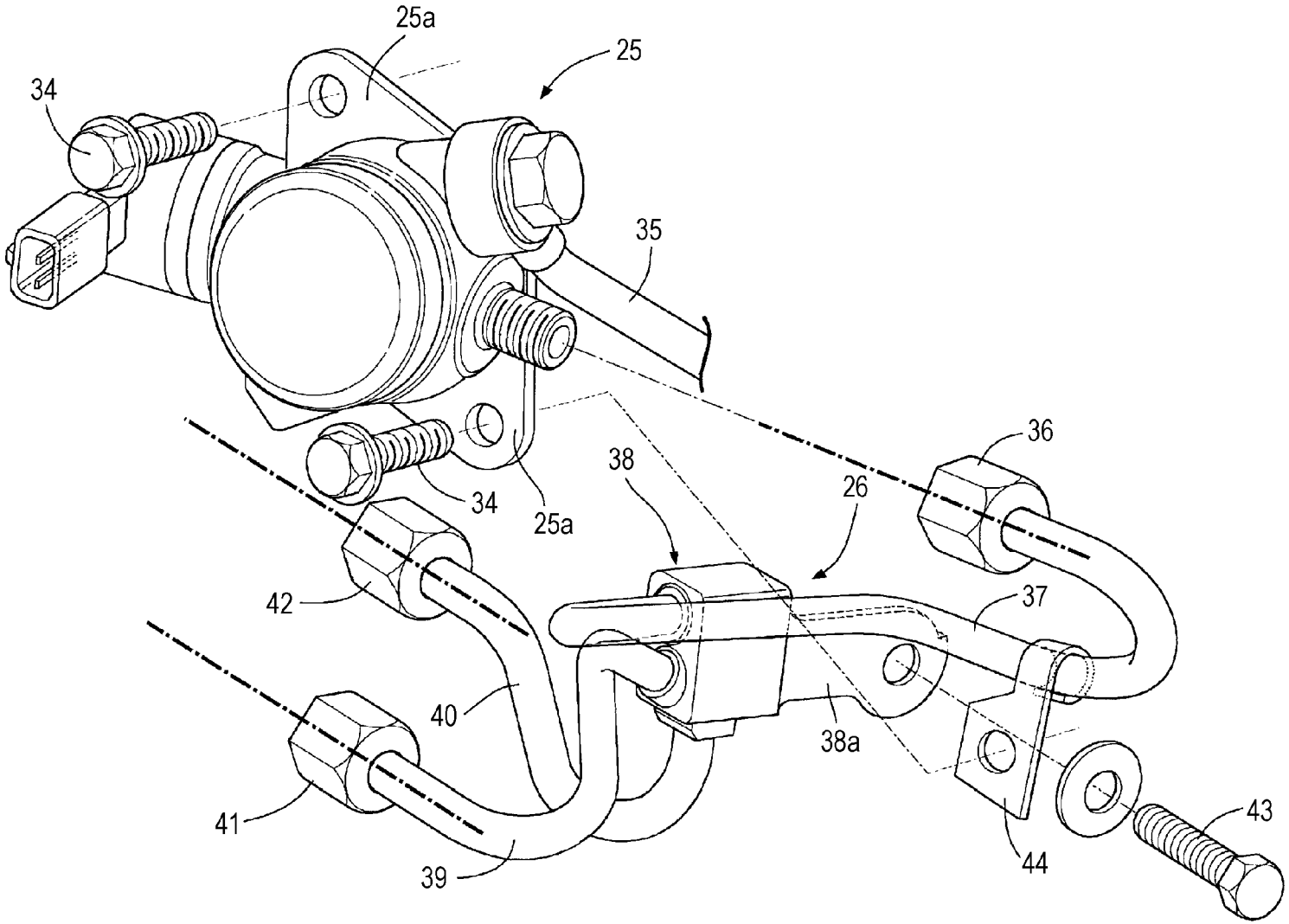
FIG. 5 is perspective view of a high-pressure fuel pump and joint pipes.

As illustrated in FIGS. 2 and 5, the high-pressure fuel pump 25 has two attachment brackets 25*a;* two bolts 34 that pass therethrough are screwed into the second cylinder head 12B.

The high-pressure fuel pump 25 pressurizes fuel taken in from a fuel tank (not shown) through a feed pipe 35 and sends the pressurized fuel to the joint pipe 26.

The joint pipe 26 includes a pre-branching joint pipe 37, which is connected to the high-pressure fuel pump 25 via a first joint 36, a joint box 38 connected to the pre-branching joint pipe 37, and first joint pipe 39 and second joint pipe 40, which branch from the joint box 38.

The first joint pipe 39 is connected to the end of the first delivery pipe 23A via a second joint 41, and the second joint pipe 40 is connected to the end of the second delivery pipe 23B via a third joint 42.

By fastening an attachment bracket 38*a* protruding from the joint box 38 to the second cylinder head 12B with a bolt 43, the joint box 38 is secured to the second cylinder head 12B.

A rotation prevention member 44 secured to a middle part of the pre-branching joint pipe 37 is fastened to the second cylinder head 12B together with one of the attachment brackets 25*a* of the high-pressure fuel pump 25 with the bolts 34.

The operation of this embodiment of the present invention will be described below.

The fuel pressurized at the high-pressure fuel pump 25 is supplied from the pre-branching joint pipe 37 to the joint box 38 and is further supplied to the first delivery pipe 23A via the first joint pipe 39 and to the second delivery pipe 23B via the second joint pipe 40.

The fuel in the first and second delivery pipes 23A and 23B is supplied from the each injector cup 27 to the corresponding fuel introduction part 24*c* of the injector 24, the actuator part 24*b* closes the valve accommodated in the valve storing part 24*a* in accordance with a predetermined fuel injection timing to inject the high pressure fuel into the combustion chambers 17.

Figure 7A:
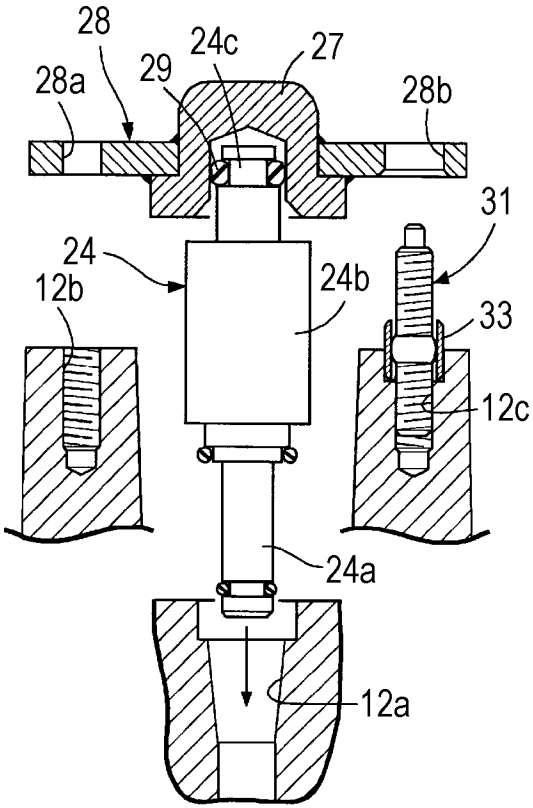
FIGS. 7A, 7B, and 7C illustrate the operation of securing a delivery pipe.

As illustrated in FIG. 7A, when the positioning precision of the first delivery pipe 23A with respect to the first cylinder head 12A is low for attaching, to the first cylinder head 12A, the first delivery pipe 23A to which the three injectors 24 are attached in advance, the end of the valve storing part 24*a* of the injector 24 strongly interferes with the injector attachment hole 12*a,* causing deformation of the valve storing part 24*a* and/or unstableness in the fuel injection.

Figure 7B:
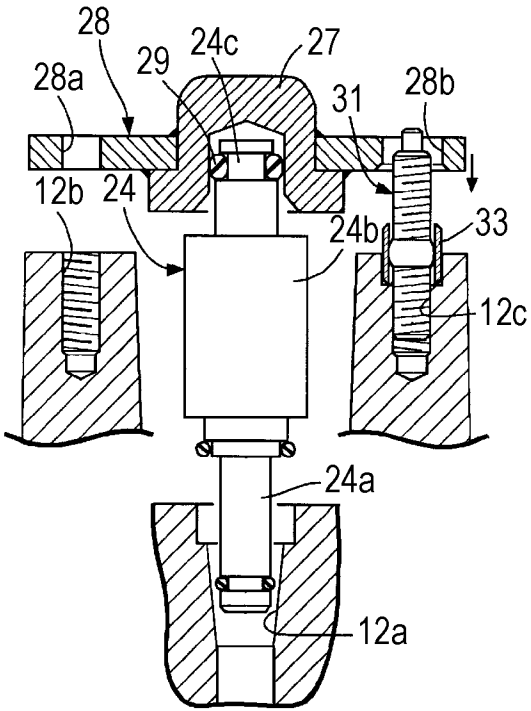

In this embodiment, among the six bolt holes 28*b* in the three attachment stays 28, the two bolt holes 28*b* at the two ends have tapered parts h1 and the stud bolts 31 and the knock pins 33 have chamfered surfaces c1 and c2, respectively; consequently, as illustrated in FIG. 7B, the stud bolts 31 and the knock pins 33 can be smoothly fit into the bolt holes 28*b.*

Figure 7C:
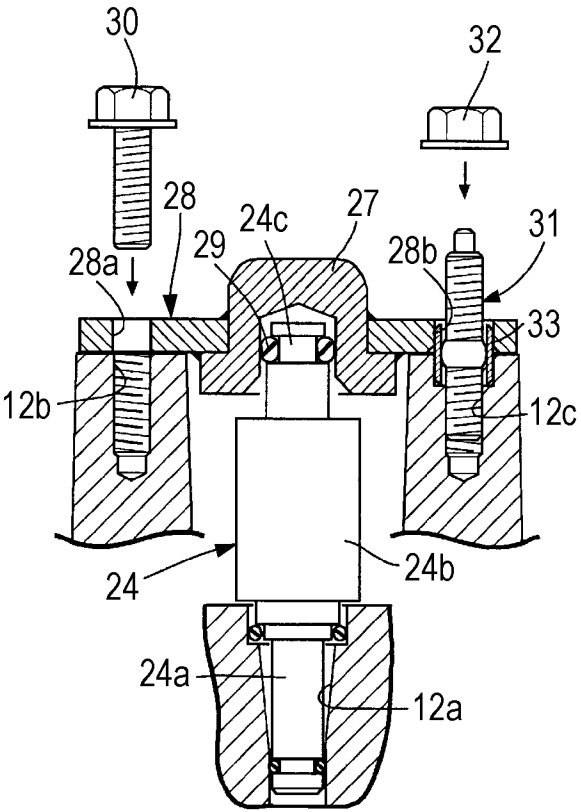

Since the isodiametric parts h2 of the bolt holes 28*b* tightly fit together with the outer circumferential surfaces of the knock pins 33 when the knock pins 33 are fit into the bolt holes 28*b,* as illustrated in FIG. 7C, the first delivery pipe 23A can be precisely secured to the first cylinder head 12A by screwing the second male threads 31*c* of the knock pins 33 into the nuts 32.

Among the six bolt holes 28*b* of the three attachment stays 28, the tapered parts h1 are provided only on the two bolt holes 28*b* at the two ends to guide the stud bolts 31, and the isodiametric parts h2 are provided for positioning the attachment stays 28 against the knock pins 33.

Therefore, compared with when all six bolt holes have the structure described above, the bolts are less likely to be caught in the bolt holes during assembly and the processing hours of the attachment stays 28 can be reduced while satisfactory guiding and positioning are achieved.

Finally, the four bolts 30 are screwed into the female threads 12*b* to secure the first delivery pipe 23A.

The second delivery pipe 23B is secured in the same manner as the above-described first delivery pipe 23A.

As described above, after the first and second cylinder heads 12A and 12B are respectively secured to the first and second delivery pipes 23A and 23B, the high-pressure fuel pump 25 and the first and second delivery pipes 23A and 23B are connected via the joint pipe 26.

Specifically, the first joint 36 of the pre-branching joint pipe 37 of the joint pipe 26 is connected to the high-pressure fuel pump 25, the second joint 41 of the first joint pipe 39 is connected to the first delivery pipe 23A, and the third joint 42 of the second joint pipe 40 is connected to the second delivery pipe 23B.

As illustrated in FIGS. 4 and 5, since the first, second, and third joints 36, 41, and 42 are joined in substantially the same longitudinal direction, operability is significantly improved compared with when the first, second, and third joins 36, 41, and 42 are joined in different directions.

If the pre-branching joint pipe 37 rotates together with the first joint 36 when the first joint 36 is rotated to connect the pre-branching joint pipe 37 to the high-pressure fuel pump 25, the joint pipe 26 may deform.

The pre-branching joint pipe 37 can be reliably prevented from rotating together with the first joint 36 because the middle part of the pre-branching joint pipe 37 is engaged with the second cylinder head 12B with the rotation prevention member 44.

An increase in the temperature of the engine E due to operation causes the first and second banks 13A and 13B to thermally expand in the directions of the cylinder axes LA and LB.

Therefore, the position of the second joint 41 of the first joint pipe 39 moves upward in the direction of the cylinder axis LA, and the position of the third joint 42 of the second joint pipe 40 moves upward in the direction of the cylinder axis LB.

As a result, the first joint pipe 39 and the second joint pipe 40 are pulled, and stress is generated in the lateral direction at the parts of the joint pipes 39 and 40 connecting to the joint box 38, causing an adverse effect on durability.

According to this embodiment, as illustrated in FIG. 2, the direction TA in which the first joint pipe 39 is connected to the joint box 38 and the direction in which the second joint 41 of the first joint pipe 39 thermally expands (i.e., the direction of cylinder axis LA) are substantially parallel, and the direction TB in which the second joint pipe 40 connects to the joint box 38 and the direction in which the third joint 42 of the second joint pipe 40 thermally expands (i.e., the direction of cylinder axis LB) are substantially parallel.

Consequently, the stress generated by the sections where the first and second joint pipes 39 and 40 connect to the joint box 38 being strained in the lateral direction can be minimized to increase durability.

Various modifications may be made to the embodiment described above within the scope of the invention.

For example, in the above-described embodiment, the first and second joint pipes 39 and 40 are connected to the joint box 38. Instead, the joint pipes 39 and 40 may be directly connected to the high-pressure fuel pump 25.

In the above-described embodiment, the rotation prevention member 44 is secured to the second bank 13B. Instead, the rotation prevention member 44 may be secured to the first bank 13A.

According to the embodiment of the present invention, fuel pressurized by a high-pressure fuel pump is distributed to a plurality of injectors disposed on a first bank via a first joint pipe and a first delivery pipe and to a plurality of injectors disposed on a second bank via a second joint pipe and a second delivery pipe.

Since the direction of the connecting part of the first joint pipe on the side of the high-pressure fuel pump matches the direction of thermal expansion of the first bank, and the direction of the connecting part of the second joint pipe on the side of the high-pressure fuel pump matches the direction of thermal expansion of the second bank, even when the connecting parts of the first and second joint pipes on the sides of the first and second delivery pipes move due to thermal expansion, the generation of intense stress is prevented by preventing the connecting parts on side of the high-pressure fuel pump from being stained to increase the durability of the first and second joint pipes.

The embodiment of the present invention provides a fuel supply system of a vee engine in which the direction of thermal expansion of the first bank may match a cylinder axis of the first bank, and the direction of thermal expansion of the second bank may match a cylinder axis of the second bank.

According to the embodiment, since the direction of the thermal expansion of the first and second banks is set in direction of the cylinder axes of banks, even when the connecting parts of the first and second delivery pipes of the first and second banks move in the directions of the cylinder axes, intense stress can be prevented from being applied to the connecting parts of the first and second joint pipes on side of the high-pressure pump.

The embodiment of the present invention provides a fuel supply system of a vee engine which may further include a pre-branching joint pipe, upstream of the pre-branching joint pipe connecting to the high-pressure fuel pump, and downstream of the pre-branching joint pipe branching into the first joint pipe and the second joint pipe, wherein the pre-branching joint pipe, the first joint pipe, and the second joint pipe may be respectively attached to the high-pressure fuel pump, the first delivery pipe, and the second delivery pipe in substantially the same direction.

According to the embodiment, when the pre-branching joint pipe is connected to the high-pressure fuel pump, and the first and second joint pipes branching from the pre-branching joint pipe are respectively connected to the first and second delivery pipes, the pre-branching joint pipe and the first and second joint pipes can be respectively attached to the high-pressure fuel pump and the first and second delivery pipes in substantially the same direction; therefore, operability of the attachment can be improved.

The embodiment of the present invention provides a fuel supply system of a vee engine in which a rotation prevention member engaging the pre-branching joint pipe may be disposed on the first bank or the second bank.

According to the embodiment, since a rotation prevention member, which is engaged with the pre-branching joint pipe, is disposed on the first bank or the second bank, the pre-branching joint pipe can be prevented from rotating together with the high-pressure fuel pump while securing the pre-branching joint pipe to the high-pressure fuel pump, and thus, operability of attaching the pre-branching joint pipe can be improved.

Obviously, numerous modifications and variations of the present invention are possible in light of the above teachings. It is therefore to be understood that within the scope of the appended claims, the invention may be practiced otherwise than as specifically described herein.

What is claimed is:

1. A fuel supply system of a vee engine, comprising:

a first delivery pipe to distribute fuel to a plurality of injectors disposed on a first bank;

a second delivery pipe to distribute the fuel to a plurality of injectors disposed on a second bank;

a high-pressure fuel pump to pressurize the fuel;

a first joint pipe through which the fuel is to be supplied from the high-pressure fuel pump to the first delivery pipe;

a second joint pipe through which the fuel is to be supplied from the high-pressure fuel pump to the second delivery pipe;

a direction of a connecting part of the first joint pipe on a side of the high-pressure fuel pump substantially matching a direction of a cylinder axis of the first bank; and a direction of a connecting part of the second joint pipe on a side of the high-pressure fuel pump substantially matching a direction of a cylinder axis of the second bank.

2. The fuel supply system according to claim 1, further comprising:

a pre-branching joint pipe, an upstream portion of the pre-branching joint pipe connecting to the high-pressure fuel pump, a downstream portion of the pre-branching joint pipe branching into the first joint pipe and the second joint pipe, wherein the pre-branching joint pipe, the first joint pipe, and the second joint pipe are respectively attached to the high-pressure fuel pump, the first delivery pipe, and the second delivery pipe in substantially a same direction.

3. The fuel supply system according to claim 2, further comprising:

a rotation prevention member disposed on the first bank or the second bank to engage the pre-branching joint pipe.

4. The fuel supply system according to claim 2, further comprising:

a first stay to connect the first delivery pipe to a first cylinder head; and a second stay to connect the second delivery pipe to a second cylinder head, wherein the first delivery pipe includes a first end and a second end opposite to the first end, the first joint pipe being connected to the first end of the first delivery pipe, the first stay being closer to the first end than to the second end, wherein the first delivery pipe is positioned with respect to the first cylinder head with a first positioning mechanism provided at the first stay, wherein the second delivery pipe includes a first end and a second end opposite to the first end of the second delivery pipe, the second joint pipe being connected to the first end of the second delivery pipe, the second stay being closer to the first end of the second delivery pipe than to the second end of the second delivery pipe, and wherein the second delivery pipe is positioned with respect to the second cylinder head with a second positioning mechanism provided at the second stay.

5. The fuel supply system according to claim 3, wherein the rotation prevention member is provided on the second bank, and wherein a high-pressure fuel pump is attached to the second bank.

6. The fuel supply system according to claim 4, further comprising:

a rotation prevention member disposed on the first bank or the second bank to engage the pre-branching joint pipe.

7. The fuel supply system according to claim 6, wherein the rotation prevention member is provided on the second bank, and wherein a high-pressure fuel pump is attached to the second bank.

8. The fuel supply system according to claim 1, wherein the direction of the connecting part of the first joint pipe on the side of the high-pressure fuel pump substantially matching a direction of thermal expansion of the first bank, and wherein the direction of the connecting part of the second joint pipe on the side of the high-pressure fuel pump substantially matching a direction of thermal expansion of the second bank.

9. The fuel supply system according to claim 1, further comprising:

a joint box having an inlet configured to receive the fuel supplied from the high-pressure fuel pump, a first outlet directly connected to connecting part of the first joint pipe, and a second outlet directly connected to the connecting part of the second joint pipe.

* * * * *